United States Patent [19]

Kristen et al.

[11] Patent Number: 4,580,550

[45] Date of Patent: Apr. 8, 1986

[54] COOKING PANEL COMPRISING GAS-FIRED BURNER UNITS AND A CONTINUOUS COOKING SURFACE OF GLASS CERAMIC OR A COMPARABLE MATERIAL

[75] Inventors: Klaus Kristen, Wiesbaden; Herwig Scheidler, Mainz-Finthen; Fred Rieck, Mainz-Bretzenheim, all of Fed. Rep. of Germany

[73] Assignee: Schott Glaswerke, Mainz, Fed. Rep. of Germany

[21] Appl. No.: 604,991

[22] Filed: Apr. 27, 1984

[30] Foreign Application Priority Data

Apr. 30, 1983 [DE] Fed. Rep. of Germany ..... 3315745
Mar. 14, 1984 [DE] Fed. Rep. of Germany ..... 3409334

[51] Int. Cl.[4] ..... F24C 3/04

[52] U.S. Cl. ..... 126/39 J; 126/39 H; 126/39 K; 431/285; 431/351

[58] Field of Search ..... 126/39 H, 39 J, 39 E, 126/39 R; 431/10, 351, 352, 165, 285; 337/394, 382, 383, 387, 389

[56] References Cited

U.S. PATENT DOCUMENTS 3,624,352 11/1971 Deaton et al. ..... 126/39 J
4,067,681 1/1978 Reid, Jr. et al. ..... 126/39 J X
4,083,355 4/1978 Schwank ..... 126/39 J
4,130,104 12/1978 Kristen et al. ..... 126/39 J
4,189,294 2/1980 Rice et al. ..... 126/39 J X
4,201,184 5/1980 Scheidler et al. ..... 126/39 J

FOREIGN PATENT DOCUMENTS 2440701 3/1976 Fed. Rep. of Germany .
2633849 3/1977 Fed. Rep. of Germany .
2721921 11/1978 Fed. Rep. of Germany .
2058722 5/1971 France .
2076174 9/1971 France .

*Primary Examiner*—Larry Jones
*Attorney, Agent, or Firm*—Hill, Van Santen, Steadman & Simpson

[57] ABSTRACT

A cooking panel comprising gas-fired burner units and a continuous cooking surface consisting of glass ceramic or comparable material which is particularly suited for incorporation in kitchen appliances consists of one or two, low-height structural parts in which all main components if the burner units such as combustion chamber, gas mixing chamber, gas mixing means, exhaust gas ducts, warming zones and exhaust gas stack are integrated. These integrated structural parts can be economically manufactured with known wet molding techniques for silicate fiber material—this leading to a weight reduction—and can be built in with a minimum of assembly outlay.

32 Claims, 17 Drawing Figures

1
2
6
12
13
5
10
11
9
-7-
-8-
II

Fig. 9
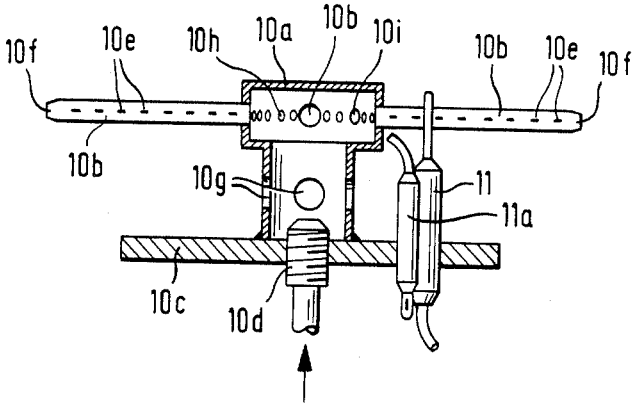
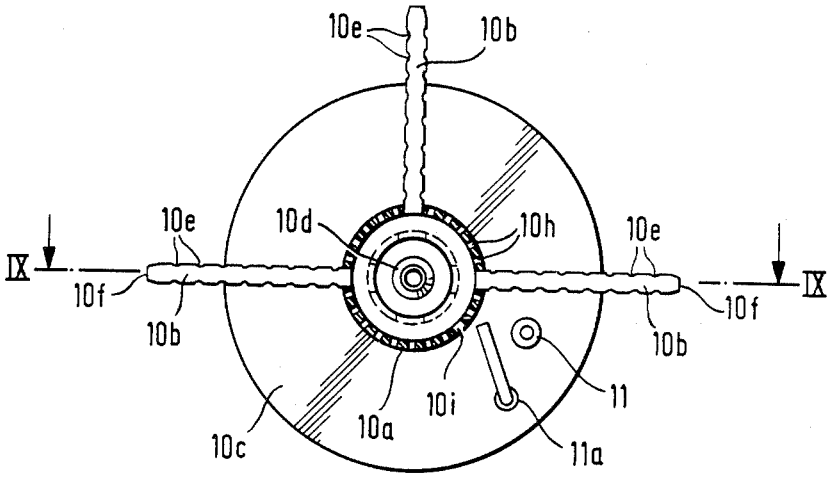
Fig. 9a

COOKING PANEL COMPRISING GAS-FIRED BURNER UNITS AND A CONTINUOUS COOKING SURFACE OF GLASS CERAMIC OR A COMPARABLE MATERIAL

BACKGROUND OF THE INVENTION

1. Field of the Invention

The invention relates to a cooking panel whose cooking units are heated with gas burners which are covered by a common or continuous cooking surface, consisting of glass ceramic or similar material.

2. Description of the Prior Art

Gas-fired cooking panels having a continuous cooking surface of glass ceramic or similar material are known. They are disclosed, for example, in the German Pat. Nos. 24 40 701, 27 21 921, 26 33 849 as well as in the French Pat. Nos. 2 058 722 and 2 076 174. The cooking units of these known cooking panels are heated with radiant gas burners according, for example, to the German Pat. Nos. 26 33 849 or with atmospheric burners. Differences between the embodiments according to the aforementioned patents consist, among other things, in the manner of managing the combustion air and the exhaust gas, this being done with auxiliary blowers in some of the devices—that, for instance, according to the German Pat. No. 20 76 174.

The fundamental structure of known cooking appliances of the type described above shall be described below with reference to the example of a cooking panel comprising a continuous cooking surface of glass ceramic heated with radiant gas burners that is equipped with three cooking zones and one warmer zone.

Each cooking zone of this cooking panel has a radiant gas burner allocated to it, the burner consisting of a gas mixing chamber with an externally attached venturi tube with a gas jet and a perforated ceramic plate which upwardly terminates the gas mixing chamber. The German Pat. No. 26 33 849 describes this type of burner. In operation, this ceramic plate is caused to glow by means of small flames that burn at the end of the perforation and functions as a heat radiator. A sheet metal ring, referred to as the exhaust gas ring, is put in place on this burner arrangement as a combustion chamber limitation, the ring being supported on a plurality of springs secured to the combustion chamber and being pressed by the springs against the glass ceramic cooking surface from below via a sealing ring consisting of refractory material. The exhaust gas ring carries a rod expansion switch for temperature limitation of the burner and the required ignition and monitoring electrodes as well as an exhaust gas nozzle. The latter discharges into an exhaust gas channel consisting of sheet metal which eliminates the burner exhaust into the warmer zone or directly out of the cavity. The warmer zone is heated by the exhaust gases of one or more cooking unit burners. It consists of an upwardly open sheet metal trough comprising a sealing ring and connections for the exhaust gas ducts as well as an exhaust stack. It is likewise pressed against the cooking surface by means of springs and conducts the exhaust gases into the open air via a system of baffle plates which serve the purpose of intimately mixing the hot exhaust gases with the cool ambient air.

All three cooking unit burners are completely independent of one another and consist of the above-described main components in addition to further piece parts.

The cooking unit burners are controlled with allocated solenoid valves that are disposed in the cavity space in the course of the gas conduits. A separate, thermally insulated housing is provided for the temperature-sensitive control and monitoring electronics, the housing being attached laterally or to the front of the cooking panel or being externally mounted at some other location.

The various, known cooking panels of the type described above are respectively constructed of similar component parts having equivalent functions and include a number of disadvantages:

The separate manufacture of the numerous, sometimes complex components as piece parts is cost-intensive and the assembly of the cooking panel necessarily requires a great assembly outlay with high assembly cost. The multitude of components promotes susceptibility to malfunction and reduces the service friendliness of these cooking panels. Also disadvantageous are the high weight of these cooking panels as well as the lack of versatility in the selection of the cooking unit diameters and the disposition of the cooking zones in the cooking surface. It is also disadvantageous that the individual burners have large structural heights, wherewith large overall heights of the cooking panels necessarily follow, in turn preventing easy incorporation of these cooking panels in kitchen appliances. A further disadvantage of the known cooking panels with gas firing and a continuous cooking surface is that the exhaust-carrying parts of sheet metal become very hot during operation and thus heat the cavity space surrounding the burner unit, so that electrical lines and auxiliary elements such as, for example, gas control valves that are disposed in the cavity space are exposed to great temperature stresses.

A further disadvantage given the known cooking panels is that the electrical ignition and flame monitoring require complex electronic control devices that are cost-intensive and which, due to their temperature sensitivity can only be disposed in spaces that are well thermally insulated, usually outside of the cavity space.

SUMMARY OF THE INVENTION

An object of the invention is therefore a cooking panel for gas firing comprising a continuous cooking surface of glass ceramic or similar material which avoids the described disadvantages, which, in particular, can be manufactured simply and cost-favorably with low assembly outlay, which is operational reliable and service-friendly, is constructed mechanically stable given low overall weight and good thermal insulation, and which, given a low built-in depth, simultaneously guarantees the greatest possible freedom in view of the selection of the cooking zone diameters as well as the disposition of the cooking and warmer zones in the cooking surface.

BRIEF DESCRIPTION OF THE DRAWINGS

FIG. 9 is a side sectional view of a pilot light.

FIG. 9*a* is a plan view of the pilot light shown in FIG. 9.

FIG. 10 is a plan view of the burner units with the cooking surface removed.

DESCRIPTION OF THE PREFERRED EMBODIMENTS

The main element of the gas-fired cooking panel comprising a continuous cooking surface of glass ceramic or similar material according to the invention is a low-mass component of refractory material, preferably consisting of aluminum silicate fibers with an inorganic binder, in which all burner units as well as one or more warmer zones of the cooking panel are molded with their essential components.

Figure 1:
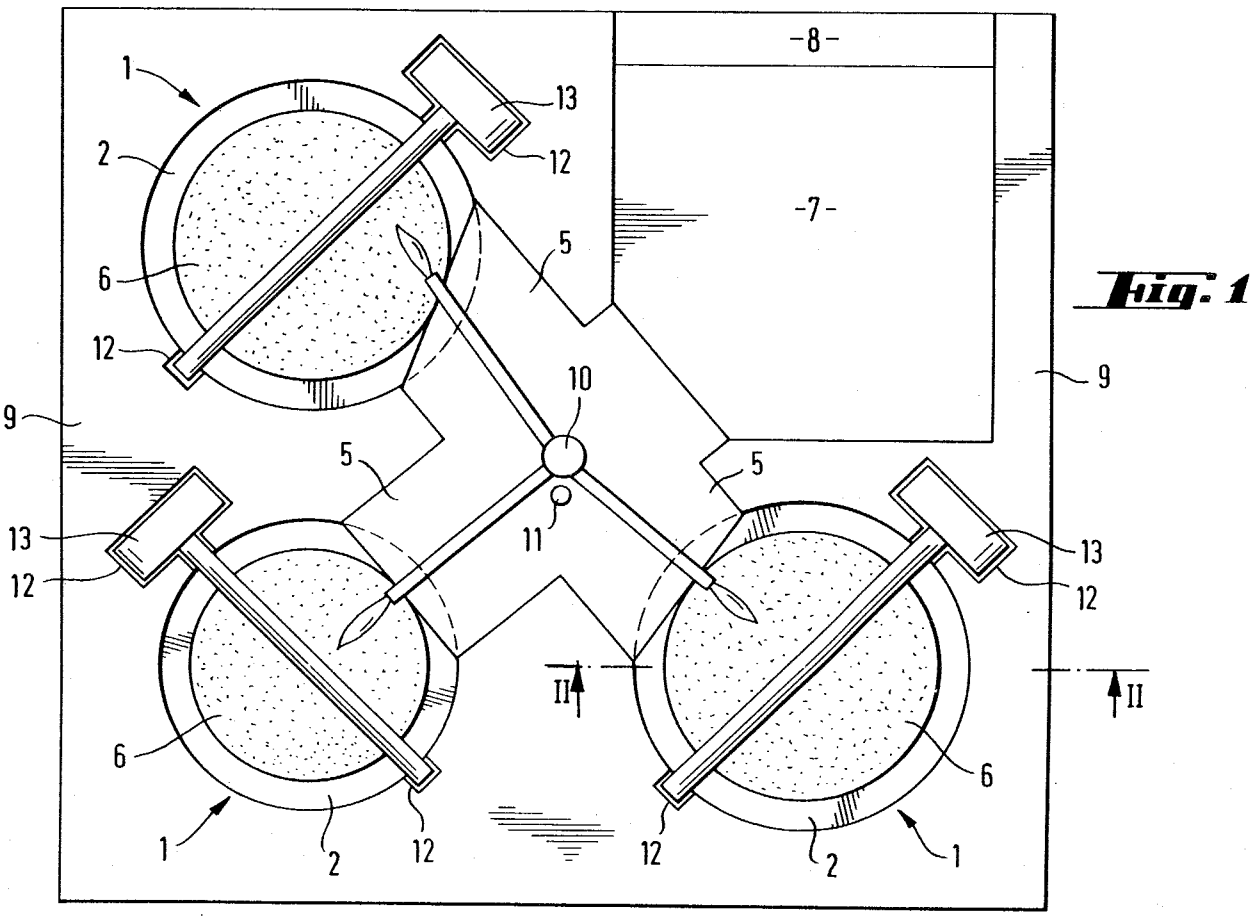
FIG. 1 is a top plan view of the burner units with the cooking unit removed.
Figure 2:
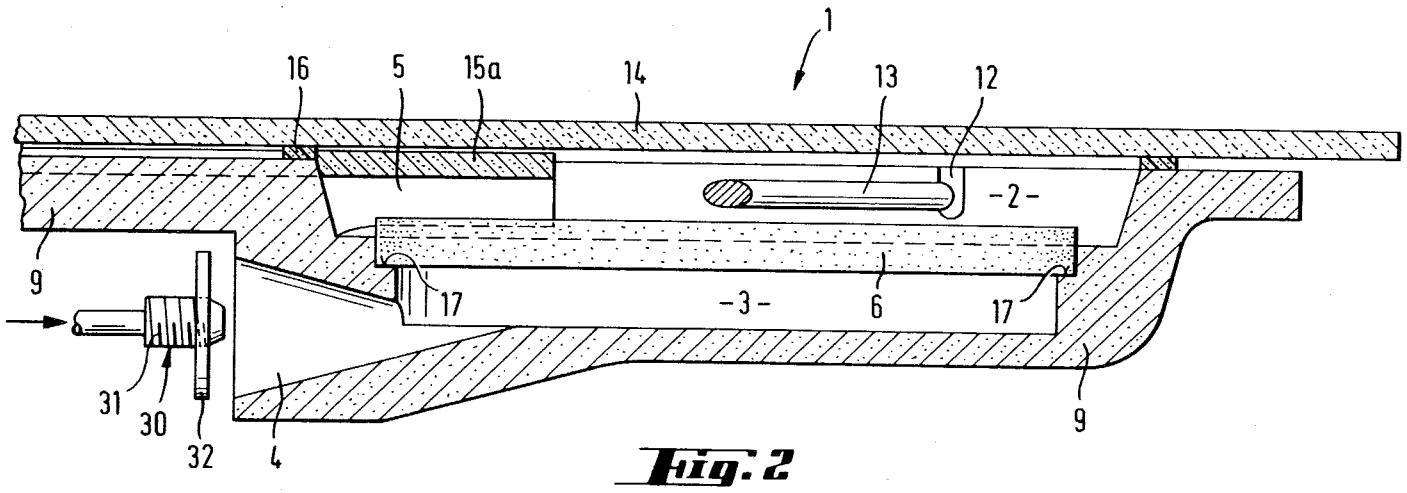
FIG. 2 is a side sectional view of a burner unit with the cooking panel in place.

Such a structural part for cooking panels comprising three cooking units that are heated with radiant gas burners and that are equipped with a warmer zone is shown in plan view in FIG. 1; FIG. 2 shows a section along the line II—II in FIG. 1 through the right front cooking unit burner 1 in this low-mass structural part 1 consisting of refractory material.

In the plan view (FIG. 1) onto the structural part 9, one can see three cooking unit burners 1 having circular, perforated ceramic plates or jet plates 6 of which only one-fourth is respectively illustrated. The jet plates 6 separate combustion chambers 2 from gas mixing chambers 3 that are situated therebelow and which are not illustrated in FIG. 1 (see FIG. 2). Exhaust gas ducts 5 lead from the combustion chambers 2 to the center of the cooking panel. A pilot light 10 shared by all cooking unit burners 1 and comprising an ignition and monitoring means 11 is situated in the center and shall be described later.

The exhaust gas ducts 5 conduct the exhaust gases from the center into a warmer zone 7 having an exhaust stack 8 through which the exhaust gases are eliminated from the cooking cavity. Depressions 12 are also molded into the structural part 9, temperature limiters 13, rod expansion switches in this case, being inserted thereinto with precise fit and being capable of being pemanently fixed there. The electrical feeder lines of the temperature limiters 13 as well as other electrical auxiliaries that are not shown in FIG. 1, for instance, the leads of ignition and monitoring electrodes, can expediently be manufactured of solid wires that are co-embedded in the mass of refractory material when the part 9 is molded and thus act as an additional stiffening of the structural part 9 after drying. Further details of the structural part 9 consisting of refractory material proceed from the section in FIG. 2. For the sake of clarity, all parts shown in FIG. 1 that are behind the cooking unit burner 1 such as, for example, the warmer zone 7, are not shown in FIG. 2.

The gas mixing chamber 3 of the burner 1 with a gas mixing means 4 is formed onto the combustion chambers 2 in FIG. 2. The jet plate 6 is supported around on a seat 17 and is glued in this seat 17 with adhesive (not shown), preferably an inorganic, refractory bonding agent. The exhaust gas duct 5 is covered by a separate refractory part 15*a* comprising a cover. The cover 15*a* is expediently manufactured of the same material as part 9 and is glued into it. The sealing of the combustion chamber 2 relative to the cooking surface 14 is assumed by a soft seal 16 consisting of aluminum silicate fiber.

All three cooking unit burners of the cooking panel according to the invention are constructed in the same fashion and molded into the structural part 9 with their components such as combustion chamber 2, gas mixing chamber 3, exhaust gas duct 5, gas mixing means 4 together with the warming zone 7 and the exhaust stack 8.

The entire heating means of the cooking panel thus consists of a single, thermally well-insulating structural part having a low overall height, the part 9, that can be economically manufactured with known wet molding techniques for silicate fiber material and can be built into the cooking panel with minimum assembly outlay. Additional adjustment work such as required in the known cooking panels is largely eliminated with precise-fit recesses 12 in part 9 for the temperature limiters 13 and potential, additional recesses (not shown) for the ignition and monitoring unit 11 of the central pilot light 10. There are no restrictions with respect to the placement of the gas mixing units 4 in the structural part 9 so that they can be placed at the respectively most favorable locations in the structural part 9 in order to further reduce the assembly outlay. Additionally, the greatest possible freedom with respect to the selection of the cooking unit diameters and their position in the cooking surface is provided within the framework of the commonly prescribed dimensions of the cooking surface 14.

The gas mixing means 4 (FIG. 2) is described as follows: The conical bore in FIG. 2 cooperates with a gas jet 30 as an injector through which the combustion air is suctioned in. The necessary over-pressure in the gas mixing chamber 3 is achieved by means of the sudden reduction in cross-section at the end of the conical bore down to the cross-section of the mixing chamber 3. The gas is mixed with the combustion air by means of eddy formation at the same time.

The air quantity can be regulated with an air choke plate 32 that is screwed onto a thread 31 of the gas jet 30. Tests have shown that the burners 1 function well with this simple mixer means 4 and that, in particularly, the exhaust gas hygiene according to regulations is assured.

The gas jet 30 and the air choke plate 32 are not integrated into the structural part 9. They are expediently combined in a prefabricated unit for all burners together without the required gas admission conduits and gas control valves.

The structural part 9 can be manufactured of one-piece or, should the molding technology applied require it, can be composed of a plurality of parts. It can, for example, be divided into an upper part and a lower part by means of a parting plane indicted in FIG. 3 with the line E—E, said upper and lower parts being separately manufactured and subsequently glued or mechanically pressed together.

Figures 3, 3A:
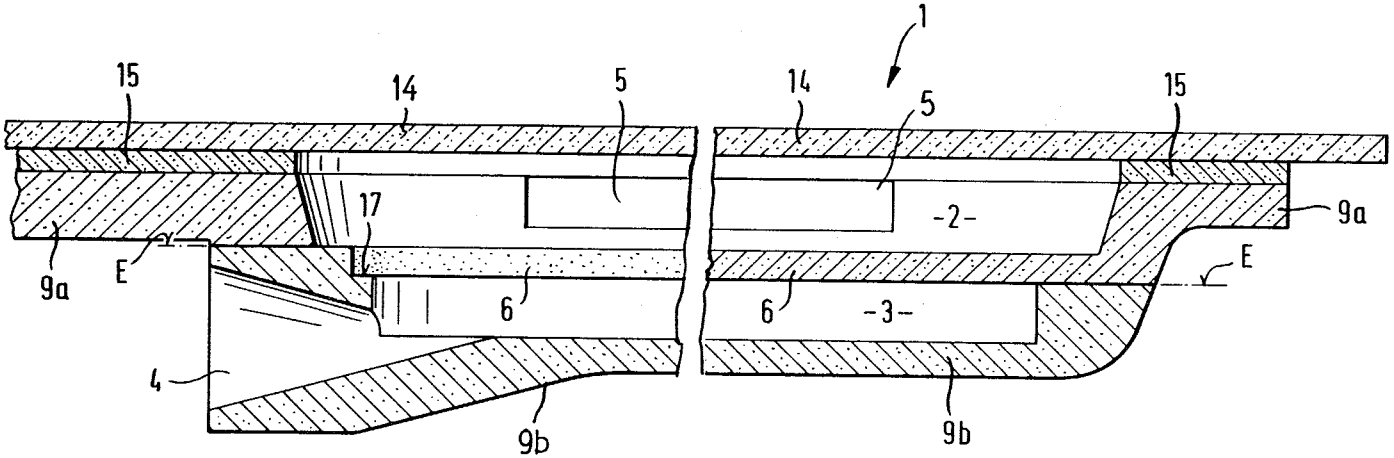
FIG. 3 is a partial side sectional view of an alternative embodiment of a burner unit.
FIG. 3*a* is a partial side sectional view for alternative embodiment of a burner unit.
Figure 4:
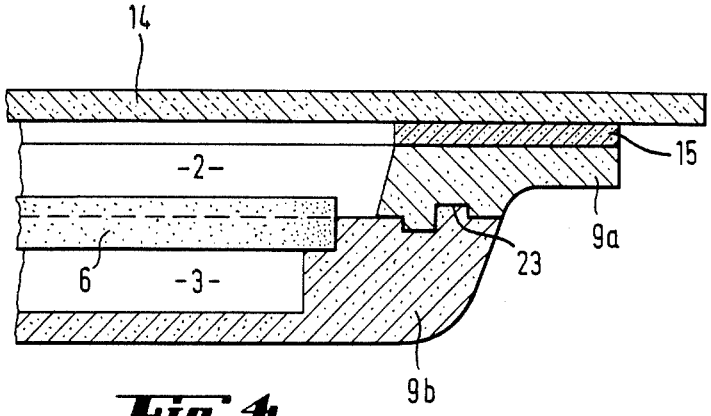
FIG. 4 is a partial side sectional view of a burner unit showing a labyrinthoseal.
Figure 4A:
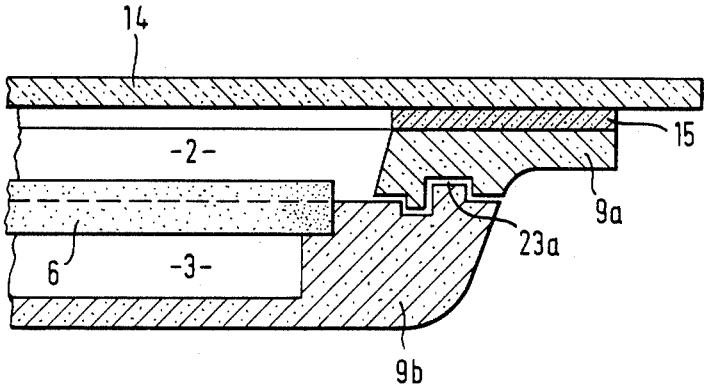
FIG. 4*a* is a partial side sectional view of a burner unit with the labyrinthoseal having an air gap.

FIGS. 3, 4 and 4*a* show further embodiments of the cooking cavity according to the invention. Identical positional numbers in these and all further Figures indicate structural parts having the same function or, respectively, indicate identical structural parts. Given the embodiment according to FIG. 3, the covers 15*a* and the sealing rings 16 (FIG. 2) have been replaced by a common cover plate 15 which covers all exhaust gas conducts 5 (FIG. 3) and from which the openings for the combustion chambers 2 of the cooking unit burners 1 (FIG. 1) and the warmer zone 7 (FIG. 1) are punched. Like the part 9, the cover plate 15 is manufactured of, for example, aluminum silicate fiber material having an inorganic binder. It can be glued to the cooking surface 14. The structural part 9 is executed bipartite in this case and is formed by the upper part 9*a* and the lower part 9*b* whose parting plane is indicated with the line E—E in FIG. 3.

The jet plate 6 consisting of a special ceramic material is glued into the seat 17 provided therefor, as shown at the left in FIG. 3. Alternatively, the jet plate 6 is manufactured of silicate fiber material and is molded in one work step with the upper part 9*a*, as shown at the right in FIG. 3. In contrast to the above-described execution with a glued-in jet plate (FIG. 2) consisting of a special ceramic compound, the jet plate is a component part of the structural part 9 in this case, arising when the parts 9*a* and 9*b* are bonded in the plane E—E.

An embodiment wherein the upper part 9*a* is not bonded to the lower part 9*b* is shown in FIG. 4. The two parts are equipped with the elements of a labyrinth seal 23 and are pressed tightly against one another with a press means. The remaining parts in FIG. 4 correspond to the illustrations in FIGS. 2 and 3.

For reasons of stability, there is often a demand that the cooking surface 14 be able to move or, respectively sag in the direction toward the jet plate 6 given percussive stresses. In order to produce the necessary play, the labyrinth seals 23 are executed with the air gap having a height of 1.5 mm through 2 mm, as shown in FIG. 4*a* at 23*a*.

Figure 5:
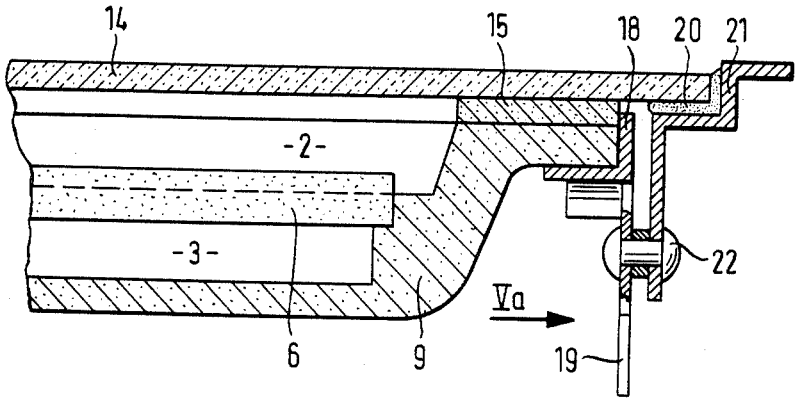
FIG. 5 is a partial side sectional view showing an easily maneuvered lever for removing a burner from the cooking panel.
Figure 5A:
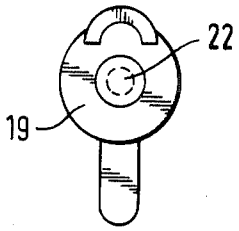
FIG. 5*a* is an end view of the lever shown in FIG. 5.

FIGS. 5 and 5*a* show a simple and service-friendly apparatus for assembling the complete heating unit which is composed of the structural part 9 (FIG. 2) and the cover plate 15 (FIG. 3). These parts are placed in an auxiliary frame 18 consisting of the parts 9 and 15 against the cooking surface 14 with levers 19, as shown in FIG. 5*a*. To this end, the levers 19 are rotatably secured to a cooking surface frame 21 with rivets 22, the frame 21 being in turn rigidly connected to the cooking surface 14 via an adhesive 20.

Figure 6:
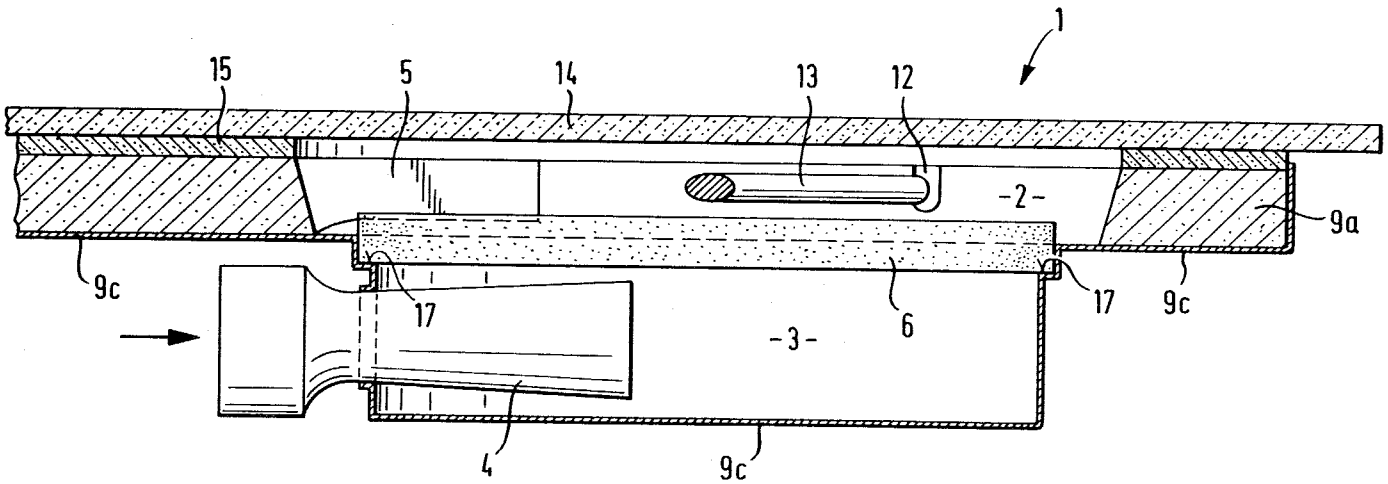
FIG. 6 is a side sectional view of an alternative embodiment of the burner unit.

The above-described structural part 9 can also be manufactured of refractory material and sheet metal in a hybrid format such as is shown in FIG. 6. The parts 9*a* and 15 of refractory material (FIG. 3) which define the combustion chambers 2 and the exhaust gas ducts 5 as well as the warmer zone 7 (FIG. 1) are expediently retained. Instead of the lower part 9*b* (FIG. 3), the mixing chambers 3 (FIG. 6) comprising an all-around seat 17 into which the jet plates 6 can be glued are now impressed into a common sheet metal trough 9*c*. If necessary, further depressions for the region of the warming zone 7 (FIG. 1) and the exhaust gas duct regions can be impressed in the sheet metal trough. Additional beads can serve to stiffen the sheet metal trough 9*c*. The parts 9*a* and 15*a* are laid or, respectively, glued into the trough 9*c*. The mixing chambers 3 are supplied with the gas/air mixture over applied mixing means 4, for example venturi tubes that can partially project into the mixing chambers.

Figure 7:
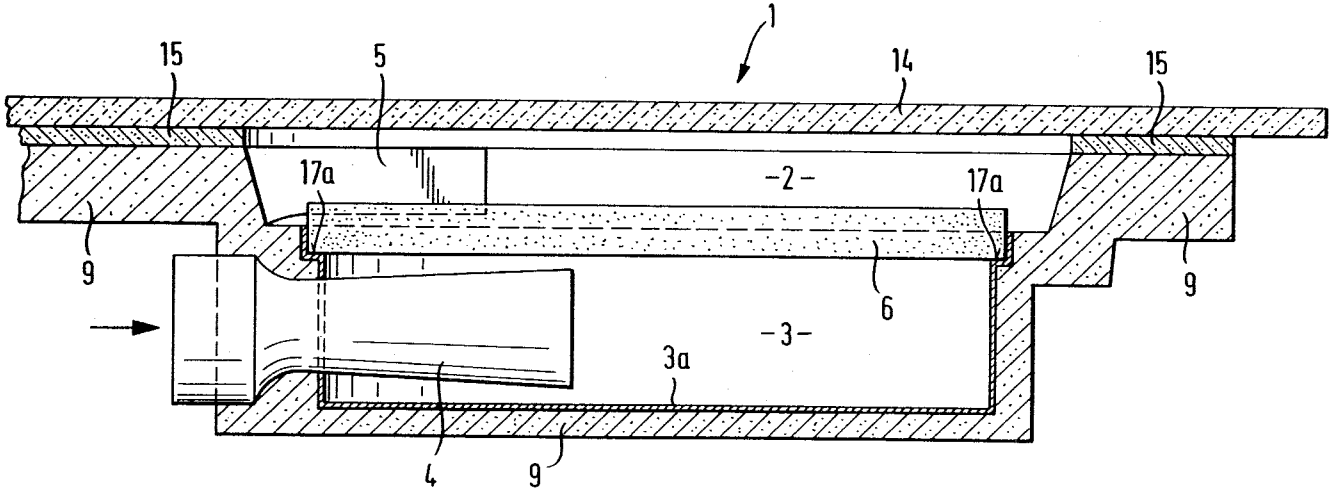
FIG. 7 is a side sectional view of an alternative embodiment of the burner unit.

The weight of the cooking cavity can be further reduced in that the common structural part 9 for the cooking unit burners 1 and the warming zone 7 (FIG. 1) is manufactured of expanded aluminum silicate material having a binder. When this material is open-pored, then an additional seal is required in the region of the gas mixing chamber of the structural part 9. As shown in FIG. 7, this seal can be achieved in that a gas mixing chamber is inserted into the structural part 9 as a sheet metal bucket 3*a* into whose seat 17*a* the jet plate 6 is glued. The sheet metal bucket 3*a* is expediently rigidly glued to the structural part 9*a*. The sheet metal bucket 3*a* can also be disposed such that it externally surrounds the gas mixing chamber 3 molded into the structural part 9. All further features of the arrangement in FIG. 7 correspond to the features of the embodiments described above.

Figure 8:
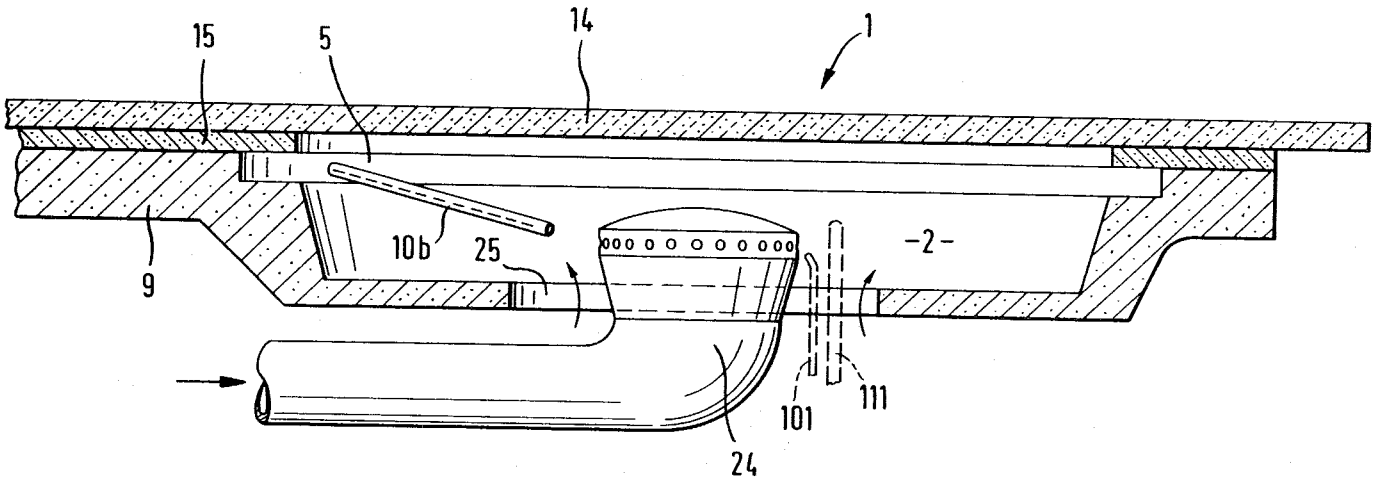
FIG. 8 is a side sectional view of an alternative embodiment of the burner unit using an atmospheric burner.

In the above-cited examples, the cooking unit burners 1 (FIG. 1) are constructed as radiant gas burners or gas jet burners comprising a mixing chamber 3 and the jet plate 6. When the structural part 9 (FIGS. 2 or 3) is modified in accordance with FIG. 8, then atmospheric burners can be utilized for heating the cooking unit. The combustion chamber 2 in FIG. 8 is larger than in the preceeding example and the mixing chamber is eliminated. The burner exhaust of the atmospheric burner 24 proceeds via an annular exhaust gas duct 5 at the upper edge of the combustion chamber 2 that is covered by the cover plate 15 into an exhaust gas duct system that can, for example, be executed in accordance with FIG. 1 and heats the warming zone 7 (FIG. 1). An exhaustor is expediently attached to the exhaust stack 8 (FIG. 1) of the warming zone 7 in a known manner, the exhaustor promoting the exhaust gas flow and seeing to the induced aeration of the combustion chamber 2 in FIG. 8 through the large bottom opening 25. The burner 24 is ignited through the exhaust gas duct 5 via a pilot light in the center of the cooking panel that is provided there in common for all burner units of the cooking panel. Only the trigger tube 10*b* of this pilotlight is shown in FIG. 8. When the cooking unit burners are individually ignited and monitored, then ignition electrodes 101 and monitoring thermocouples 111 are provided at the respective burner 24 in a known manner instead of the common pilot light. These parts are indicated with broken lines in FIG. 8.

The operating reliability of the cooking panels having radiant gas burners is significantly improved when a gas safety switch that is protected in a known manner with a thermocouple is disposed in front of the solenoid valves that are required for the control of the calorific output of the cooking unit. It is advantageous that the monitoring circuit comprising thermocouple and gas safety switch works without auxiliary energy and completely independent of the control circuit comprising the solenoid valves and offers additional safety in case of failure of the solenoid valve. Expediently and cost-favorably, a common pilot light 10 with monitoring thermocouple 11 is provided, as shown schematically in FIG. 1, this actuating a common gas safety switch for all burner units 1 which is inserted in the main gas line of the cooking panel.

FIG. 9 shows a suitable pilot light, for example for the ignition and monitoring of three burner units. Ignition tubes 10*b* having fine bores or slots 10*e* disposed behind one another on a line are attached to the gas port block 10*a* which is equipped with fine bores 10*h* and a jet 10*i* for the monitoring flame. The ends of the ignition tubes 10*b* are designed as a jet 10*f*. This system is supplied with gas via the gas jet 10*d*, whereby the required combustion air is sucked in through the bores 10*g* in the lower part of the gas port block. The gas port block 10*a*, the gas jet 10*d* and the ignition electrode 11*a* as well as the monitoring thermocouple 11 are secured in common on or, respectively, in the console 10*c*.

When the gas/air mixture flows into the burner, it emerges at the fine bores 10*h* and 10*e* as well as at the pilot light jet 10*i* and the end jets 10*f* of the ignition tube. A flame border that ignites the gas/air mixture at the jets 10*f* is formed during ignition both around the gas port block 10*a* as well as along the ignition tube 10*b*. Pilot lights can thus burn into the combustion chambers of the cooking unit burners or, respectively, a gas/air mixture emerging from them is ignited.

An auxiliary gas flow is diverted from the gas mixing chambers of the cooking unit burners 1 (FIG. 10) over separate feeder lines or respectively, the illustrated bores 27 whose diameters are greater than the jet orifices of the jet plate 6 and is conducted through the webs 26 which bound ignition channels 26*a* in the exhaust gas ducts 5 to the ignition gas port block 10*a* and is ignited there, so that gas/air mixture flowing from the jet plate 6 is in turn ignited by means of flashback via the already ignited auxiliary gas flow.

The ignition of the gas mixture proceeding from the burner (FIG. 9) through the channels 26*a* can advantageously ensue by means of a catalytically acting ignition surface which is disposed in the center of the exhaust gas ducts 5 instead of the pilot light and which is heated indirectly either with gas or electrically. A thermocouple is provided for monitoring ignition, this monitoring the temperature of the ignition surface.

Figure 11:
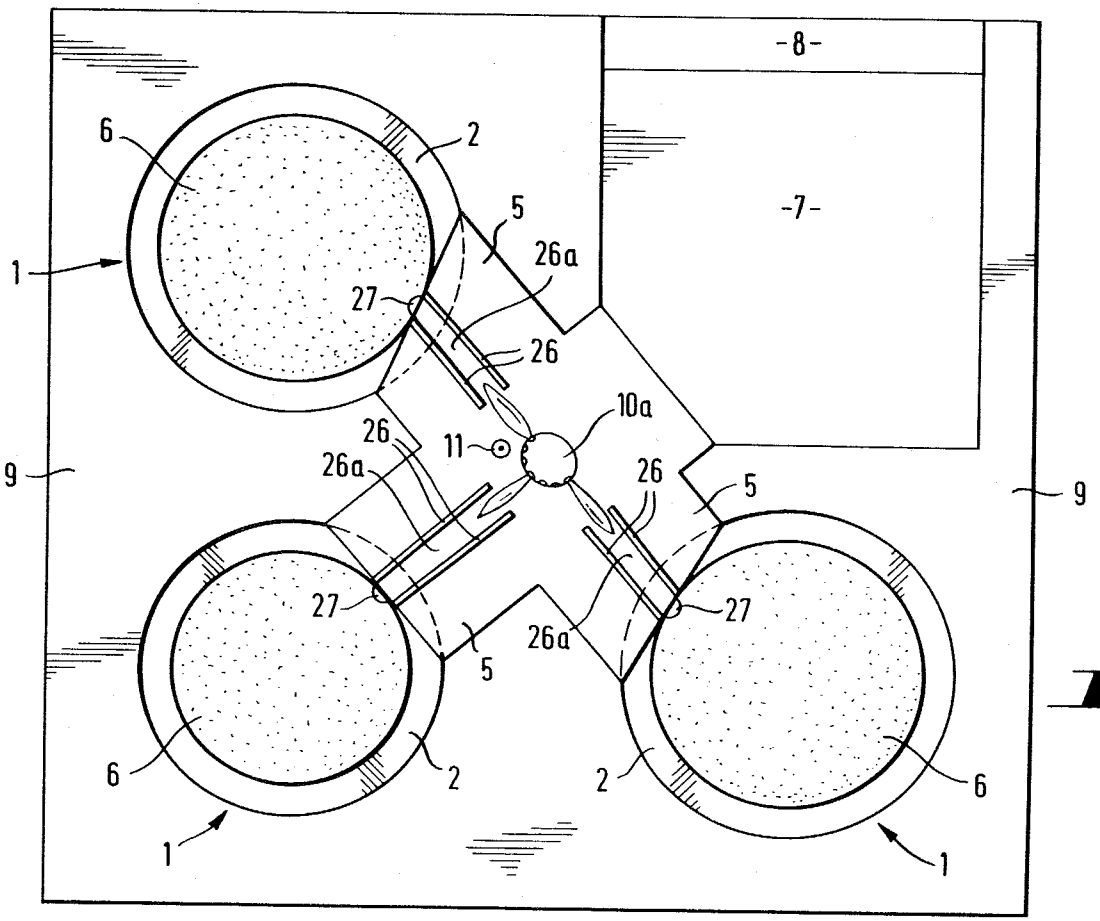
FIG. 11 is a side sectional view of an alternative embodiment of the burner unit.
Figure 11:
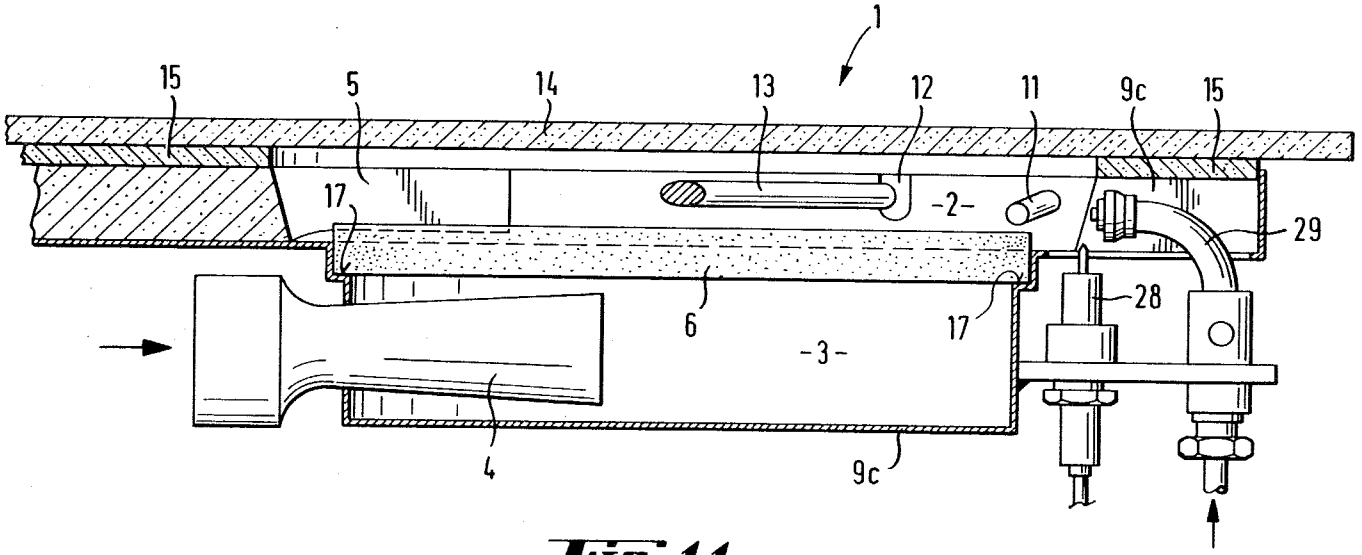

When a separate pilot light is employed with an appertaining gas safety switch for each burner unit, then the pilot lights can be disposed as shown in FIG. 11. Openings are provided in the structural parts 9*a* and 9*c* such that the pilot light 20 which forms a unit with the ignition electrode 28 projects to the edge of the combustion chamber 2 so that the pilot flame can heat the monitoring thermocouple 11*a*. It is advantageous given this arrangement that the pilot flame of the burner 29 burns right above the burner jet plate 6, wherewith the gas/air mixture of the main burner is ignited immediately upon actuation of the cooking unit switch.

Figure 12:
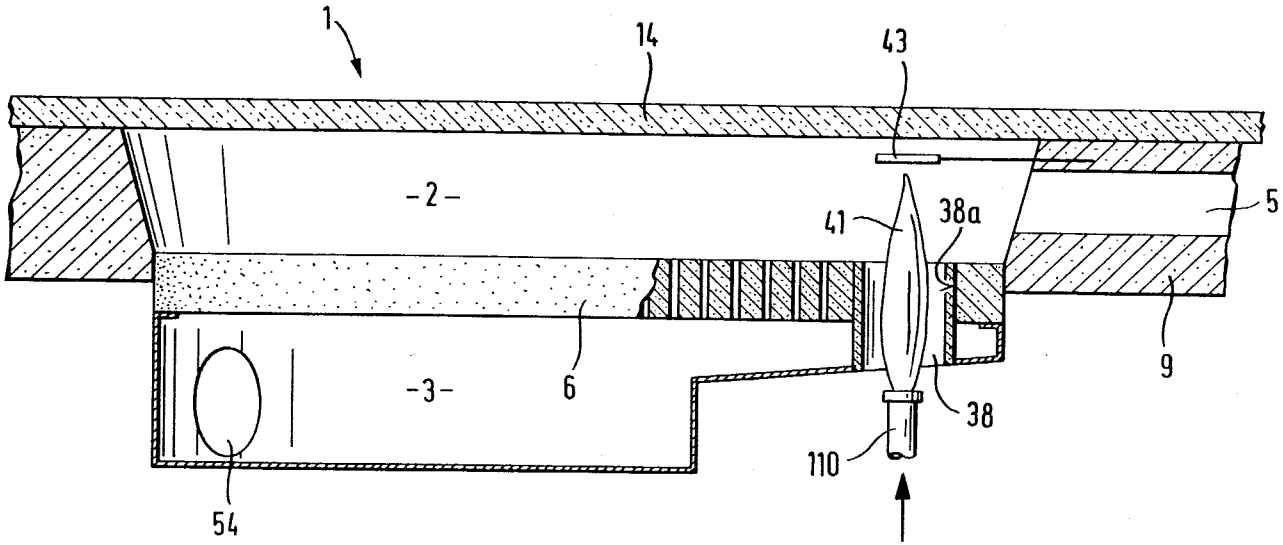
FIG. 12 is a side sectional view of an alternative embodiment of the burner unit.

FIG. 12 shows a cooking unit burner 1 comprising the combustion chamber 2 and the exhaust gas duct 5 which are both formed into the structural part 9 of refractory material and comprising the gas mixing chamber 3 and the gas admission 54. The gas mixing chamber is covered by the jet plate 6. The cumbustion chamber 2 is terminated by the cooking surface 14.

The jet plate 6 and the housing or the gas mixing chamber 3 comprise an opening 38*a* in the proximity of the exhaust gas channel for the pilot flame 41 of the pilot light 110 attached below the opening 38*a*. A ceramic tube 38 in the opening 38*a* is bonded gas-tight to the jet plate 6 and to the housing of the gas mixing chamber 3 so that no gas/air mixture of the cooking unit burner 1 proceeds from its mixing chamber 3 into the combustion chamber 2.

The pilot flame 41 now burns perpendicular to the flow of exhaust gas from the cooking unit burner 1 and is no longer unfavorably influenced by said flow, even during ignition and extinguishing processes. In particular, the pilot flame 41 is kept from going out due to pressure surges in the combustion chamber 2 with this pilot burner arrangement.

As a further embodiment according to FIG. 12, flow element 43 is attached above the opening 38*a* and below the cooking surface 14, said flow element preventing the tip of the pilot flame 41 from topically overheating the cooking surface 14. The flow element 43 can, for example, consist of a heat-resistant wire wound into a flat spiral and, given transparent cooking surfaces, simultaneously serves as a luminous display for the presence of the pilot flame. As known from incandscent hoods, it can, for example, be coated with a mixture of thorium and ceroxide in order to improve the luminous spot and/or can consist of or be coated with, for example, platinum which catalytically promotes the ignition of the air/gas mixture in the combustion chamber 2 of the cooking unit burner 1.

Figure 13:
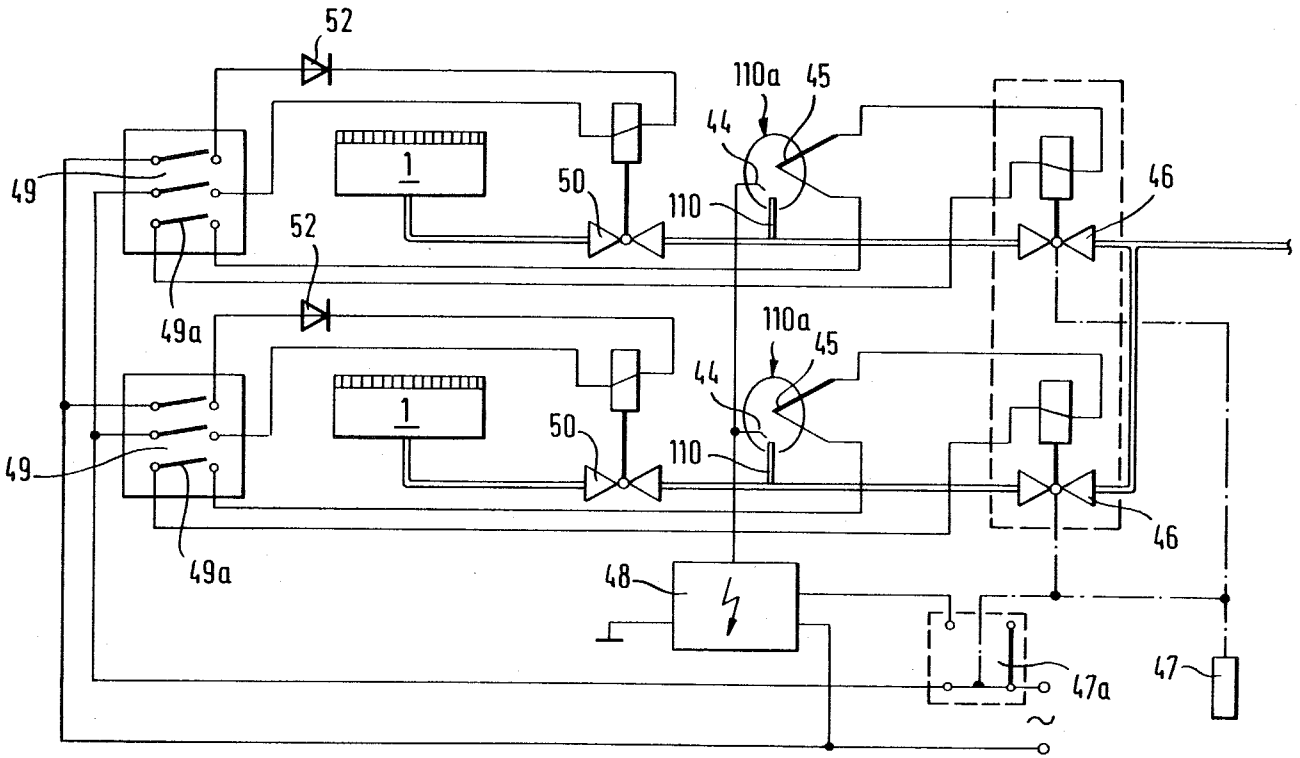
FIG. 13 is a schematic diagram showing the controls and burner units.

The manner of functioning of the cooking unit burner 1, particularly its ignition and ignition supervision, is seen in the schematic diagram of the cooking panel comprising two cooking unit burners shown in FIG. 13.

The gas safety switches 46 are combined in a block, this being indicated in FIG. 13 by means of a broken line around the parts 46. The manual actuation of the gas safety switches 46 and an electrical change-over switch 47*a* are mechanically coupled to one another and to a manual key 47. This mechanical coupling is shown in FIG. 13 by means of the dot-dash line. Further, the double lines marked in black and white identify the gas-carrying conduits in FIG. 13. A pilot burner unit 110*a* consisting of a pilot burner 110 with ignition electrode 44 and thermocouple 45 is allocated to each cooking unit burner 1, as are an electromagnetic control valve 50 and an energy regulator 49. The gas safety switches 46 and the control valves 50 are combined into a structural unit. The ignition electrodes 44 are supplied by the high voltage means 48. A switch 49*a* which is coupled to the corresponding energy regulator 49 is inserted in the control circuit of the thermocouples 45. With the assistance of an electrically heated bimetallic switch, the energy regulators 49 generate a chronological clocking of the supply stream of the control valves 50 and thus control the temperature of the cooking unit via the selectable on-time of the cooking unit burner 1 in a known manner. The D.C. voltage required for the control valves 50 is generated with the rectifiers 52. A rod limit switch (not shown) which is disposed in the combustion chamber 2 of the cooking unit burner 1 interrupts the coil current of the control valves 50 when the temperature of the cooking unit exceeds the maximum allowable value.

In order to light one of the two cooking unit burners 1, its energy regulator 49 is switched on and, thus, the contact 19*a* in the thermocouple circuit is also closed. The allocated control valve 50 opens simultaneously. The control valve 50 is thereby switched currentless by the changover switch 47*a* and inhibits the gas feed to the cooking unit burner 1 for the duration of the ignition operation of the pilot burner 110. At the same time, the change over switch 47*a* switches the high voltage means 48 on and the spark ignition 44 of the pilot burner 110 is placed in operation. Both pilot burners are supplied with gas via the gas safety switches 46 opened at the same time by the manual key 47 and ignited.

When the hand key is released after a few seconds have elapsed, the changover switch 47*a* switches the high voltage means 48 and, thus, the ignition spark off. At the same time, this switch re-engages the power supply to the energy regulator 49 and the control valve 50 of the previously switched-on cooking unit burner 1 is opened. When the corresponding thermocouple of the pilot burner 110 of this cooking unit burner 1 is hot enough, the allocated gas safety switch 46 remains open because the thermocouple circuit is closed with the switch 49*a* and, thus, the valve plate of the gas safety switch is retained in the "open" position by its current coil. In contrast thereto, the pilot burner 110 of the cooking unit that has not been turned on is extinguished when the manual key 47 is released because its thermocouple cirucit is interrupted by the switch 49*a* in the energy regulator 49 of this cooking unit burner.

The pilot burner 110 of the cooking unit that has been turned on remains in operation independently of the allocated energy regulator 49 and rod temperature limit switch until the cooking unit is turned off at the energy regulator 49. When this is the case, both the control valve 50 as well as the current coil of the gas safety switch 46 become currentless and both valves close.

If the pilot burner 110 of the engaged cooking unit goes out for any reason during operation, the gas safety switch closes after the expiration of a safety interval and blocks the gas feed to both the pilot burner 110 as well as to the cooking unit burner 1. The cooking unit can then be re-engaged only in the manner described above by means of actuating the manual key 47.

When one of the two cooking unit burners 1 is already on and the second is to be turned on, then the described ignition operation is similarly repeated. The cooking unit burner 1 that has already been turned on is thereby extinguished for the duration of the ignition operation, whereas its pilot burner remains on. When the manual key 47 is released, the second pilot burner also remains on and both cooking unit burners light via the corresponding pilot flames.

The principle presented with reference to the preceeding example can be analogously employed in all gas equipment having a plurality of burner locations.

As is apparent from the foregoing specification, the invention is susceptible of being embodied with various alterations and modifications which may differ particularly from those that have been described in the preceeding specification and description. It should be understood that we wish to embody within the scope of the patent warranted hereon all such modifications as reasonably and properly come within the scope of our contribution to the art.

We claim as our invention:

1. A cooking panel including gas-fired burners and a continuous cooking surface fabricated of a glass ceramic-type material and having at least two cooking zones separated by means of separate burner units, said burner units having as main components combustion chambers, gas mixing chambers, gas/air mixing means, exhaust gas ducts, and a warmer zone with exhaust stack and depression for mounting of auxiliary means such as temperature limiters comprising:

said burner units and said exhaust ducts including all components of the burner units above a predefined plane being built in one single structural part, which preferably contains all said main components of said burner units, and which is fabricated of a single piece of low mass thermally insulating material, and a single igntion and ignition monitoring unit being provided for common use by all burner units.

2. A cooking panel including gas-fired burners and a continuous cooking surface fabricated of a glass ceramic-type material and having at least two cooking zones separated by means of separate burner units, said burner units having as main components combustion chambers, gas mixing chambers, gas/air mixing means, exhaust gas ducts, and a warmer zone with exhaust stack and depression for mounting of auxiliary means such as temperature limiters comprising:

said burner units and said exhaust ducts including all components of the burner units above a predefined plane being built in one single structural part, which preferably contains all said main components of said burner units, and which is fabricated of one or more pieces of low mass thermally insulating material, and a single ignition and ignition monitoring unit being provided for common use by all burner units.

3. Cooking panel according to claim 2, wherein the structural part is composed of an upper part and of a lower part consisting of the same material, whereby said defined plane is parallel to the surface of the upper part and the two parts are connected to one another gas-tight.

4. Cooking panel according to claim 2, wherein said common ignition unit is disposed in the structural part, said common ignition unit being equipped with one ignition protection unit.

5. Cooking panel according to claim 2, wherein the structural part consists of temperature-resistent and thermally insulating, compressed fibrous material having high pore volumes.

6. Cooking panel according to claim 2, wherein the burner unit exhaust gas ducts molded into the structural part discharge into a common warming zone which is in turn molded into the structural part and provided with a discharge channel.

7. Cooking panel according to claim 2, wherein the gas/air mixing device is a Venturi tube that partially projects into the gas mixing chamber.

8. Cooking panel according to claim 2, wherein metallic vessels are set into pre-formed depressions of the lower part of the structural part as the gas mixing chamber.

9. The cooking panel according to claim 2, wherein the gas mixing chamber formed in the lower part of the structural part are surrounded by a metallic vessel.

10. Cooking panel according to claim 2, wherein a jet plate which is manufactured of a ceramic material is glued into said structural part between the combustion chambers and the gas mixing chambers.

11. Cooking panel according to claim 2, wherein the upper part and the lower part are equipped with the elements of a labyrinth seal which seal the combustion chambers when the parts are mechanically pressed together.

12. Cooking panel according to claim 11, wherein the labyrinth seal is equipped with an air gap.

13. Cooking panel according to claim 2, including depressions formed in the structural part for receiving and retaining electrical operating and monitoring elements.

14. Cooking panel according to claim 2, wherein the exhaust gas ducts are covered by a cover plate; and the structural part together with the cover plate are pressed against the cooking surface via an auxiliary frame whereby the auxiliary frame is supported on spring elements that are rotatably secured to the locking surface frame by means of rivets, said spring elements springing out after impression of the auxiliary frame and clamping the auxiliary frame with the structural parts and against the cooking surface.

15. Cooking panel according to claim 2, wherein the gas-fired burners are radiant gas burners.

16. Cooking panel according to claim 2, characterized in that the gas-fired burners are atmospheric burners that are disposed in the combustion chamber of the structural part whereby additional openings through which the burner is supplied with secondary air are situated in the bottom of the combustion chamber; and in that an exhaust gas duct is annularly disposed around the burner, the exhaust gases flowing off therethrough at the edge of the combustion chamber.

17. Cooking panel according to claim 2, wherein a common pilot burner is employed for all burner units and said common pilot burner is disposed in the center of the exhaust gas ducts of the burner units.

18. Cooking panel according to claim 17, including guide channels disposed in the exhaust gas ducts of the burner units by means of webs, said guide channels conducting the gas/air mixture flowing from the combustion chamber through the openings in the jet plate to the pilot burner.

19. Cooking panel according to claim 17, wherein the common pilot burner is equipped with a plurality of ignition tubes which comprise small slots in their longitudinal direction through which a flame border burns after ignition has been accomplished along the ignition tubes, said flame border igniting the pilot burners at the ends of the ignition tubes which burn into the combustion chambers and effect ignition there when the burner units are turned on; and in that the common pilot burner is provided with a gas port block with an orifice crown and is also provided with a gas/air mixing means comprising a jet and bores in the lower part of the gas port block and is ignited and monitored with an ignition electrode as well as a thermocouple.

20. Cooking panel according to claim 2, wherein each burner unit has a separate pilot burner with its own ignition electrode and its own thermocouple or ionization sensor for monitoring the pilot flame allocated to it.

21. A cooking panel including gas-fired burners and a continuous cooking surface fabricated of a glass ceramic-type material and having at least two cooking zones separated by means of separate burner units, said burner units having as main components combustion chambers, gas/air mixing chambers, gas mixing means, exhaust gas ducts, and a warmer zone with exhaust stack and depression for mounting of auxiliary means such as temperature limiters comprising the improvement of a structural part defining said burner units which is fabricated of one or more pieces of low mass, thermally insulating material, including depressions formed in the structural part for receiving and retaining electrical operating and monitoring elements, a common ignition and ignition monitoring unit for all burner units, and further including electrical leads to the electrical operating and monitoring elements, consisting of solid wires which are implanted into the structural part when it is manufactured and which serve as stiffening elements of the structural part at the same time.

22. A cooking panel including gas-fired burners and a continuous cooking surface fabricated of a glass ceramic-type material and having at least two cooking zones separated by means of separate burner units, said burner units having as main components combustion chambers, gas/air mixing chambers, gas mixing means, exhaust gas ducts, and a warmer zone with exhaust stack and depression for mounting of auxiliary means such as temperature limiters, comprising the improvement of a structural part defining said burner units which is fabricated of one or more pieces of low mass, thermally insulating material, and a common ignition and ignition monitoring unit for all burner units, said exhaust gas ducts being covered by a cover plate; and the structural part together with the cover plate being pressed against the cooking surface via an auxiliary frame whereby the auxiliary frame is supported on locking members that are rotatably secured to the cooking surface frame by means of rivets.

23. A cooking panel including gas-fired burners and a continuous cooking surface fabricated of a glass ceramic-type material and having at least two cooking zones separated by means of separate burner units, said burner units having as main components combustion chambers, gas/air mixing chambers, gas mixing means, exhaust gas ducts, and a warmer zone with exhaust stack and depression for mounting of auxiliary means such as temperature limiters, comprising the improvement of a structural part defining said burner units which is fabricated of one or more pieces of low mass, thermally insulating material, a common ignition and ignition monitoring unit for all burner units, and a separate heat resistant tube that is rigidly connected to the mixing chambers of the burners leading from each burner unit to adjacent the pilot burner, whereby the gas/air mixture ignites at the end of said tube when the burner unit is switched on.

24. A cooking panel including gas-fired burners and a continuous cooking surface fabricated of a glass ceramic-type material and having at least two cooking zones separated by means of separate burner units, said burner units having as main components combustion chambers, gas/air mixing chambers, gas mixing means, exhaust gas ducts, and a warmer zone with exhaust stack and depression for mounting of auxiliary means such as temperature limiters, comprising improvement of a structural part defining said burner units which is fabricated of one or more pieces of low mass, thermally insulating material, and a common ignition and ignition monitoring unit for all burner units, wherein each burner unit has separate burner with its own ignition electrode and its own thermocoupled or ionization sensor for monitoring the pilot flame allocated to it, and wherein an opening through which the pilot flame burns into the combustion chamber is disposed in the jet plate of each cooking unit burner; and in that the pilot burners have gas safety switches allocated to them, these being coupled such that they are actuatable and common by a switch means for initiating the ignition operation.

25. Cooking panel according to claim 24, wherein said opening for the pilot flame is disposed in front of the exhaust gas duct of the cooking unit burner, being disposed in the jet plate thereof and in the region of the combustion chamber, whereby a tube is disposed in said opening such that no gas/air mixture of the cooking unit member proceeds from the mixing chamber thereof into the combustion chamber.

26. Cooking panel according to claim 24, wherein a control valve is allocated to every cooking unit burner, whereby the gas safety switches and the control valves of the cooking unit burners are combined to form one structural unit.

27. Cooking panel according to claim 24 wherein the switch means consists of a manual switch.

28. Cooking panel according to claim 24, wherein an electrical switch is coupled to the switch means, said electrical switch inhibiting the gas feed to the cooking unit burners via the control valves for the duration of the ignition operation of the pilot burners and simultaneously engaging the electrical spark ignition of the pilot burners.

29. Cooking panel according to claim 24, including a glow element disposed above said opening at a distance from the cooking surface such that it prevents direct contact of the pilot flame with the cooking surface and such that it functions as a signal indicator for the presence of the pilot flame.

30. Cooking panel according to claim 29, wherein the glow element consists of an incandesent wire.

31. Cooking panel according to claim 29, wherein said glow element consists of a material that catalytically promotes the ignition of the air/gas mixture.

32. Cooking panel according to claim 29, wherein said glow element is coated with a material that effects a bright luminous spot.

* * * * *